United States Patent [19]

Wingens

[11] Patent Number: 4,909,732

[45] Date of Patent: Mar. 20, 1990

[54] HEAT TREATING FURNACE

[76] Inventor: Ulrich Wingens, Rusbergstrasse 75, 5810 Witten 3, Fed. Rep. of Germany

[21] Appl. No.: 258,633

[22] Filed: Oct. 17, 1988

[30] Foreign Application Priority Data

Oct. 17, 1987 [DE] Fed. Rep. of Germany ..... 3735186

[51] Int. Cl.[4] ..... F27B 9/04

[52] U.S. Cl. ..... 432/152; 432/176; 432/205; 432/250

[58] Field of Search ..... 432/9, 21, 144, 152, 432/176, 199, 205

[56] References Cited

U.S. PATENT DOCUMENTS

| | | | |
|---|---|---|---|
| 4,490,110 | 12/1984 | Jones | 432/205 |
| 4,493,641 | 1/1985 | Hubbert | 432/176 |
| 4,516,012 | 5/1985 | Smith et al. | 432/176 |
| 4,560,348 | 12/1985 | Moller et al. | 432/205 |
| 4,596,526 | 6/1986 | Soliman | 432/205 |
| 4,787,844 | 11/1988 | Hemsath | 432/205 |
| 4,789,333 | 12/1988 | Hemsath | 432/250 |

*Primary Examiner*—Henry C. Yuen

*Attorney, Agent, or Firm*—Collard, Roe & Galgano

[57] ABSTRACT

A heat treatment furnace for treating metal workpieces has a substantially cylindrical housing. The housing surounds a heating chamber having cooling gas inlets and outlets connected to a cooling gas circulation system for circulating the gas. A plurality of nozzles forming the gas inlets are mounted on the housing on two diametrically opposite sides thereof. The two sets of nozzles simultaneously direct cooling gases towards an impact zone within the heating chamber such that cooling gases meet in the impact zone. The workpieces are also supported in the impact zone of the heating chamber. A plurality of vents forming the gas outlets are placed around the periphery of the impact zone and conduct the cooling gas out of the heating chamber and into a heat exchanger.

9 Claims, 2 Drawing Sheets

HEAT TREATING FURNACE

BACKGROUND OF THE INVENTION

1. The Field of the Invention

The invention relates to a vacuum heat treating furnace for the heat treatment of metal workpieces. Specifically the invention relates to a furnace wherein uniform heating and cooling is achieved in a simple manner.

2. Description of the Prior Art

In vacuum furnaces of the type of the present invention, which are preferably used for vacuum hardening, it is important that all surfaces of the workpieces to be treated are cooled in the cooling phase as evenly as possible. This results in the entire structure formed by the treatment having a uniformly good quality and that the workpiece will not be deformed by thermal stresses.

In vacuum furnaces of the above type, which are known and disclosed in published German patent disclosure DE-OS 32 15 509, attempts have been made to obtain uniform workpiece cooling by alternately passing or guiding cooling gases from nozzles arranged in the ceiling of the heating chamber into two gas outlet slots arranged laterally at the bottom of the heating chamber. In addition, cooling gases are blown from nozzles arranged in the bottom of the heating chamber, into two gas outlet slots arranged laterally at the ceiling of the heating chamber. By frequently reversing the stream of gas acting on the workpieces it is possible to achieve a more even cooling of the workpieces, as compared to having the cooling gas flowing in only one direction during the treatment process. However, it is impossible to cool the top side of the workpieces at the same rate as the cooling of the bottom side of the workpieces. This results in differences in the structure and thermal stresses between the workpiece top and bottom.

SUMMARY OF THE INVENTION

It is an object of the invention to provide a vacuum furnace wherein the workpieces to be treated are simultaneously and uniformly cooled on all surfaces.

It is yet another object of the invention to provide a vacuum furnace wherein the structure formed in the treatment will be identical on all the surfaces of the workpieces and the deformations caused by thermal stresses will be avoided with even greater reliability.

Accordingly these and other objects are achieved by a vacuum furnace consisting of a substantially cylindrical housing containing a heating chamber which has insulation placed against the wall of the housing. The furnace has arranged in its interior, a supporting device for holding the workpieces to be treated. The walls of this heating chamber are provided with heating elements and gas inlet openings in the form of nozzles. These nozzles are disposed on diametrically opposed sides of the heating chamber with gas outlet openings in the form of slots extending across the axial length of the heating chamber. The gas inlet openings and the gas outlet openings are connected with a gas circulation system having a blower for the circulation of the gas, and a heat exchanger for the cooling of the gas. The gas is introduced into the opposed gas inlet nozzles simultaneously and the supporting devices holding the workpieces to be treated are located in the zone where the streams of gas produced by the opposed gas inlet openings meet one another. The gas outlet openings are arranged in the wall areas neighboring this zone.

In the vacuum furnace of the present invention, the workpieces are simultaneously and uniformly cooled from the top and from the bottom. Within the area where the workpieces are to be treated, eddies are formed in the impact zone where the oppositely directed streams of gas meet one another. These eddy currents ensure intensive mixing and complete eddying of the gases thereby forming a cooling zone that is homogenous to the greatest extent possible. The gas outlet openings are arranged laterally next to the impact zone in the form of slots. This produces a pressure drop or gradient extending from the impact zone toward both sides. This pressure drop causes the cooling gas, which is heated by the workpieces, to be discharged laterally.

According to a preferred embodiment of the invention, provision is made for the nozzles forming the gas inlet openings to be directed against the workpieces held by the supporting device. In this way, the cooling gas comes into contact with the workpieces first in the impact zone and then passes out the slots serving as the gas outlets. In order to avoid the loss of heat by radiation from the heating chamber during the heating phase, the slots serving as the gas outlet openings are covered in the interior of the heating chamber by covers and are thus shielded against radiated heat. These covers are in the form of sheet metal spaced inwardly from the cross section of the slot opening. These sheet metal covers prevent radiated heat from exiting the heating chamber but do not interfere with the exit of the cooling gas.

The gas circulation system may include control devices for controlling the amount of gas passing through the system. This permits an exact adjustment of the cooling gas quantity to whichever amount is required. Furthermore, the heating chamber has an approximately elliptical cross section, whereby the workpieces are supported by the supporting device in the plane including the major axis of the ellipse. Such a heating chamber embodiment results in a particularly efficient utilization of the interior volume of the heating chamber without impairing the uniformity of the cooling process.

These and other objects and advantages of the present invention will become apparent from the following description of the accompanying drawings, which disclose one embodiment of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference characters denote similar elements throughout the two views.

DESCRIPTION OF THE PREFERRED EMBODIMENT

Figure 1:
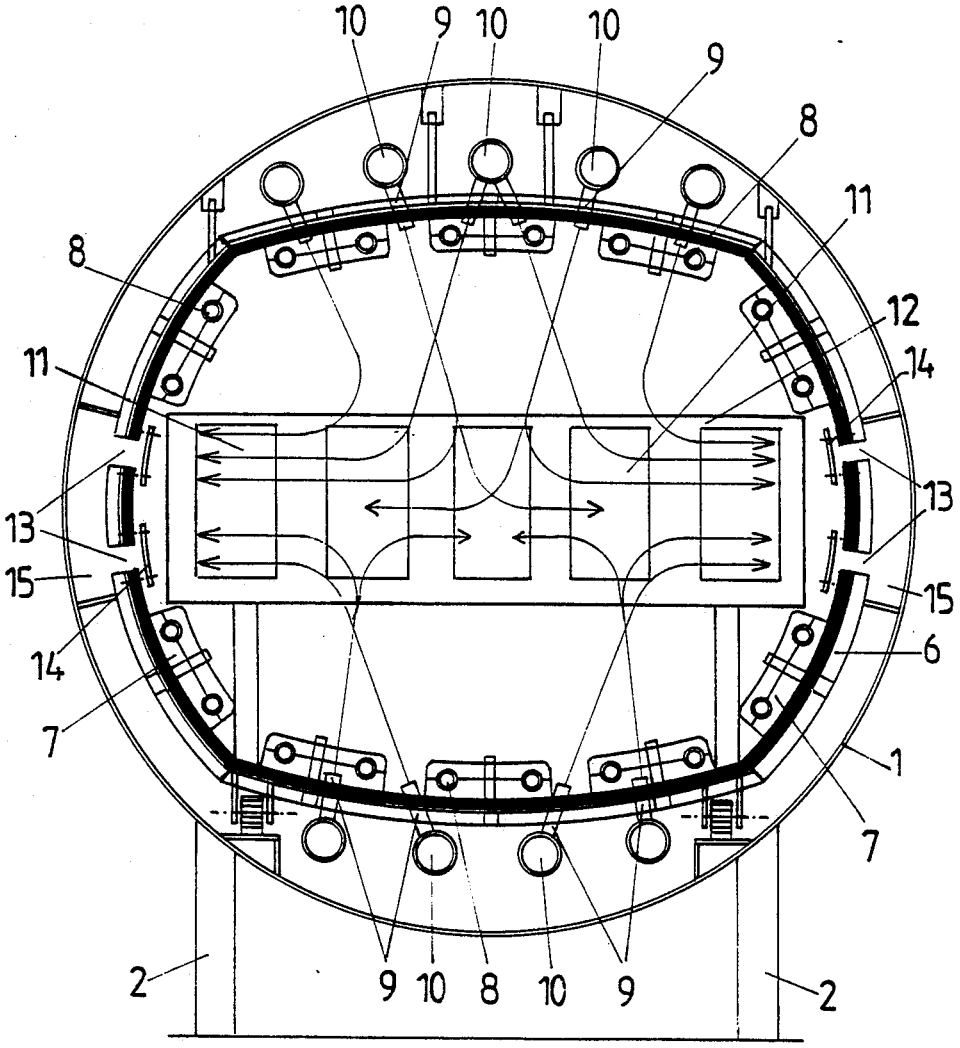
FIG. 1 is a cross-sectional view of a vacuum furnace according to the invention.
Figure 2:
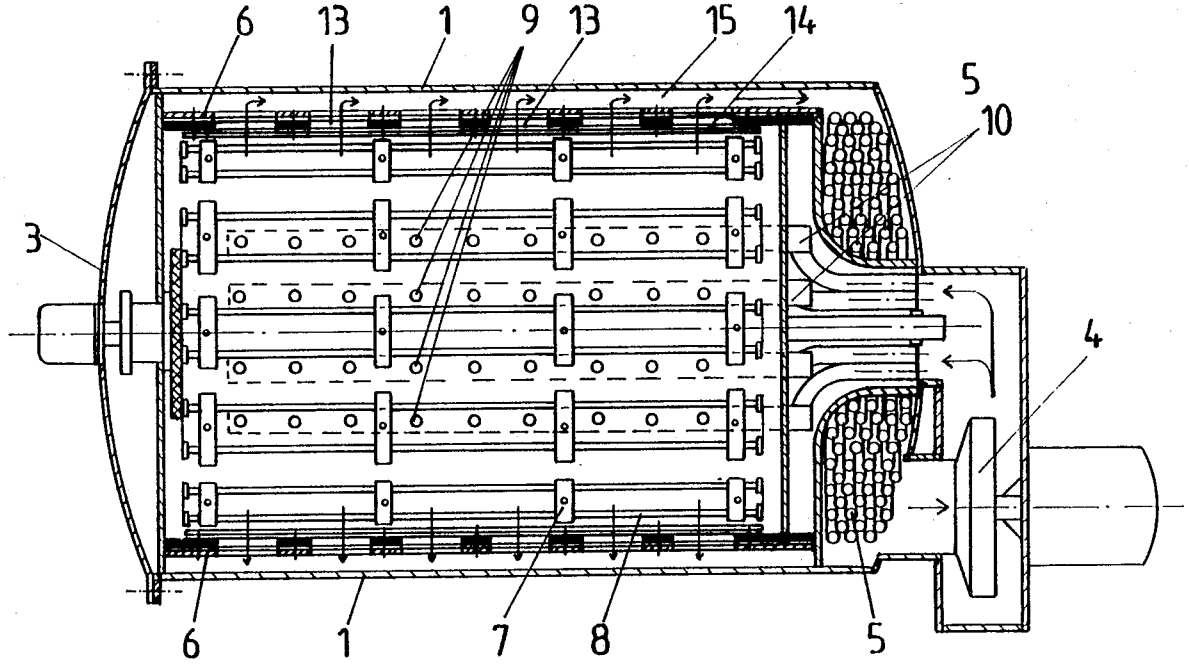
FIG. 2 is a horizontal longitudinal cross-sectional view through the furnace of the present invention, but without the supporting device and the workpieces to be treated.

Referring to FIGS. 1 and 2, there is shown a generally cylindrical vacuum furnace housing of the present invention generally denoted as 1. Housing 1 is mounted on the support legs 2 and is provided with a tightly sealed door 3 on one end thereof. On the opposite end, housing 1 is equipped with a blower 4 and a heat exchanger 5, which form part of the gas circulation system which is explained below in greater detail.

A heating chamber 6 is formed within the interior of housing 1. Heating chamber 6 has a generally elliptical cross section and has thermal insulation placed against the inner surface of the walls of housing 1. Heating rods 8 are fastened with respect to interior of housing 1 on the walls of heating chamber 6 by means of the suitable holders 7 and extend across the axial length of heating chamber 6.

In addition, provision is made for gas inlet openings in the form of a plurality of nozzles 9. Nozzles 9 are located on the top and at the bottom of heating chamber 6 and point toward the center of the chamber. Cooling gas can be admitted simultaneously to all nozzles 9 via the gas feeding conduits 10. Nozzles 9 produce gas currents which are directed toward the center plane of the heating chamber 6. Workpieces 11 to be treated are arranged and supported inside heating chamber 6 within the area of the center plane, i.e., where the gas streams produced by the opposed nozzles 9 contact one another. Workpieces 11 are supported there by a suitable supporting device 12. Supporting device 12 by way of example, may be made in the form of a pallet with a grid pattern. Gas outlet openings in the form of gas vents or slots 13 are disposed in the walls of heating chamber 6 on the sides adjacent the area where the gas streams contact. This, of course, is in the area of the center plane. Slots 13 are shielded against radiated heat by the sheet metal covers 14, which are spaced a predetermined inwardly distance from the opening of associated slot 13 so as to not interfere with the gas flow.

Slots 13 serve as the gas outlet openings and communicate with the suction side of blower 4 by way of the gas return ducts 15 and heat exchanger 5. The pressure side of blower 4 is connected with nozzle 9 by way of gas feed conduits 10. The gas circulation system consists of blower 4, gas feed conduits 10, nozzles 9, slots 13, gas return ducts 15 and heat exchanger 5. This gas circulation system is additionally equipped at suitable points with controlling and regulating elements, by which the amount of circulated gas can be controlled to meet the process requirements. Temperature sensing elements such as thermocouples may be placed throughout the furnace and connected to a computer which controls the gas flow through the furnace based on the sensed temperatures. These control and regulating elements are well known in the heat treatment art and are not shown in detail in the drawing.

The arrows at FIG. 1 indicate the direction of flow of the cooling gases and show that an impact zone is formed in the heating chamber 6 of the furnace according to the invention. The workpieces to be treated are arranged in the impact zone where the streams of gas directed by opposing sets of nozzles 9, in the top and bottom contact one another. Because of the intensive eddying, occurring as the streams of gas meet, a cooling zone is produced around workpieces 11 that is uniform to the greatest possible extent. This assures even cooling on all the surfaces of workpieces 11 that come into contact with the cooling gas. Due to the excess pressure formed within the impact zone and because gas discharge slots 13 are disposed laterally adjacent the area where the streams collide, a relatively high pressure drop is obtained between the impact zone in the direction of slots 13, so that the cooling gas travels within the impact zone at a relatively high rate.

In the embodiment shown in FIGS. 1 and 2, the impact zone is oriented horizontally in the center of heating chamber 6. If the housing has an elliptical cross section this would be along the plane including the major longer axis of ellipstical heating chamber 6. The nozzles then would be located at the ends of the minor axis of the ellipse. Of course, the impact zone can be disposed in a different area of the interior of heating chamber 6, for example in the vertical plane, if nozzles 9 and slots 13 and supporting device 12 are arranged accordingly. What is of importance is only that the streams of gas produced by nozzles 9 are placed in opposite sides of the chamber, to produce gas streams directed against one another; that the workpieces to be treated are arranged within the impact zone where such streams meet; and that the gas discharge vents or openings, in the form of slots, are disposed in the walls of the heating chamber neighboring the impact zone.

While several of the embodiments and examples of the present invention have been illustrated and described, it is obvious that many changes and modifications may be made thereunto, without departing from the spirit and scope of the invention.

What is claimed is:

1. In a heat treatment furnace for treating metal workpieces, including a housing surrounding a heating chamber defined by a heating chamber wall, means for supporting the workpieces in the heating chamber, gas inlets and gas outlets in the heating chamber wall, the gas inlets being directed centrally into the heating chamber, and the gas inlets and gas outlets being connected to a gas circulation system for circulation of the gas, the improvement comprising:

said means for supporting the workpieces being arranged along a centrally disposed plane in said heating chamber;

said gas inlets being formed by a plurality of nozzles oppositely arranged in said heating chamber wall and directed towards said centrally disposed plane so that the opposing gas currents thereby produced meet in an impact zone at said centrally disposed plane; and, said gas outlets being formed by a plurality of gas vents arranged in said heating chamber wall laterally adjacent to said impact zone.

2. The heat treating furnace as set forth in claim 1, wherein said plurality of nozzles are in two groups each forming the gas inlets directed towards opposite sides of the workpieces supported by said supporting means.

3. The heat treating furnace as set forth in claim 1, wherein the heating chamber comprises a generally cylindrical wall having insulation mounted on an inner surface thereof an having a plurality of openings therethrough forming said gas vents, a plurality of heating elements being mounted on the inner surface of said wall inwardly of an inner surface of said insulation.

4. The heat treating furnace as set forth in claim 3, further comprising a plurality of sheet metal covers mounted to said wall of the heating chamber over said plurality of openings in said wall and spaced a predetermined distance inwardly therefrom to shield said openings from radiated heat.

5. The heat treating furnace as set forth in claim 1, further comprising a means for controlling the amount of gas circulated by the gas circulation system.

6. The heat treatment furnace as set forth in claim 1, wherein the heating chamber is formed from a wall having an approximately elliptical cross section with said impact zone, said plurality of gas vents and said means for supporting the metal workpieces being located in the plane including a major axis of the elliptical cross section.

7. The heat treating furnace as set forth in claim 1, wherein said heating chamber is formed from a wall having a generally elliptical cross section with one of said two diametrically opposite sides located opposite each end of a minor axis of said elliptical cross section.

8. The heat treating furnace as set forth in claim 1, wherein said gas is used for cooling.

9. The heat treating furnace as set forth in claim 1, wherein said cylindrical housing is air-tight so that said furnace can act as a vacuum furnace prior to an introduction of cooling gas.

* * * * *